United States Patent [19]

Golden

[11] Patent Number: 4,524,673

[45] Date of Patent: Jun. 25, 1985

[54] GUN POWERED AMMUNITION MAGAZINE

[75] Inventor: Michael D. Golden, Costa Mesa, Calif.

[73] Assignee: Western Design Corporation, Irvine, Calif.

[21] Appl. No.: 428,283

[22] Filed: Sep. 29, 1982

[51] Int. Cl.[3] ..... F21C 25/10

[52] U.S. Cl. ..... 89/33.02

[58] Field of Search ..... 89/33 R, 33 D, 33 B, 89/33 BA, 33 E, 33 BB, 33 BC, 33 C, 33 CA, 33 SF, 33.02, 33.14, 33.17, 33.25, 33.04

[56] References Cited

U.S. PATENT DOCUMENTS

| | | | |
|---|---|---|---|
| 681,439 | 8/1901 | Carr | 89/33 D |
| 723,719 | 3/1903 | North | 89/33 D |
| 1,256,924 | 2/1918 | Nelson | 89/33.02 |
| 1,629,652 | 5/1927 | Browning | 89/33 D |
| 1,747,546 | 2/1930 | Janecek | 89/33 D |
| 2,394,606 | 2/1946 | Gazda | 89/33 D |
| 2,407,461 | 9/1946 | Vesely | 89/33.02 X |
| 2,974,569 | 3/1961 | Cross | 89/33.2 |
| 4,332,097 | 6/1982 | Taylor, Jr. | 89/33.02 X |

FOREIGN PATENT DOCUMENTS

| | | | |
|---|---|---|---|
| 10622 | of 1907 | United Kingdom | 89/33 D |

*Primary Examiner*—Stephen C. Bentley
*Assistant Examiner*—John S. Maples
*Attorney, Agent, or Firm*—Fowler, Lambert & Hackler

[57] ABSTRACT

A linkless ammunition magazine for small arms weapons utilizes energy taken from a reciprocating bolt to power the feeding of ammunition rounds into the weapon. No modification of existing small arms weapons is required to utilize the magazine. A spring provides an energy buffer for the power input from the reciprocating bolt and is sized to store only a small amount of energy so that it operates at a low stress level. Since the spring is not required to store sufficient energy to move all of the ammunition rounds into the weapon, a larger number of ammunition rounds may be stored in the magazine, and/or, the magazine may operate at higher rates of fire than otherwise possible with totally spring driven ammunition magazines.

15 Claims, 8 Drawing Figures

GUN POWERED AMMUNITION MAGAZINE

The present invention is directed to ammunition magazines for small arms weapons and, more particularly, is directed to an ammunition magazine which utilizes power from the weapon to drive ammunition rounds into the weapon. A small arms weapon for the purpose of the present disclosure and invention is meant to include sporting rifles, self-defense rifles, carbines, assault rifles, submachine guns, light to medium machine guns and other self powered weapons such as automatic cannons and grenade launchers in the 20 mm to 40 mm caliber range having a reciprocating bolt mechanism.

Generally, ammunition storage systems for small arms weapons are either the "clip" type or the "linked belt" type. Clip type ammunition storage devices use a spring to urge ammuninition rounds therefrom, and are reliable systems when the clip capacity is less than about thirty rounds of ammunition and the rate of ammunition round delivery into the weapon, as necessary to keep up with the firing rate of the weapon, is less than about six hundred rounds per minute.

Attempts to increase either the clip capacity or the ammunition delivery rate have enjoyed limited success because of spring limitations. Higher delivery rates typically require greater spring preloading, or compression, and larger ammunition capacity typically requires greater spring travel and preloading.

In addition, ammunition may be stored for long periods of time in fully loaded clips, hence, the springs therein are held in compression for long periods of time which may decrease the effectiveness of the spring to move ammunition out of the clip at the necessary rate of fire. This loss of effectiveness, due to spring fatigue, may cause the weapon to misfire or jam, because the spring is unable to urge an ammunition round into proper position within the weapon, in time for pick up by the bolt.

Circular type spring powered ammunition magazines have been developed, such as for the Thompson Submachine Gun Magazine and the British Vickers Machine Gun Magazine which have a greater ammunition capacity. However, they have not proved reliable due to premature drive spring failure. Further, many spring powered magazines require spring winding by the gunner prior to use. This may have dire consequences for the gunner if he forgets to wind the magazine spring.

Because manual compression of the drive spring is required, it is apparent that the spring loading undergoes large compression and decompression cycles which may lead to a variation of driving force on the ammunition rounds, which affects the rate of delivery, in addition to premature breakage.

Linked belt ammunition storage systems on the other hand are compatable with high gun firing rates and have a theoretically unlimited ammunition capacity. Since this type of ammunition storage system is typically gun powered, or motor driven, and does not rely on springs as a primary power source to move ammunition, they are not subject to the limitations of clip type ammunition storage systems.

However, the link belt system is subject to link failures, link jams and mislinked ammunition, all of which may cause gun misfire or jamming. In addition, such systems are expensive and not easily portable because of their weight. Hence, their application has been from a fixed position such as machine guns configured for firing from a bipod, tripod, or pintle mount.

The present invention is directed to an ammunition storage system having a greater ammunition round capacity and firing rate capability than the clip type, without the limitations imposed by high spring preloading, yet fully portable by a single man in an assault role. In addition, the ammunition magazine of the present invention may be used with existing small arm weapons, or guns, without any modification of the weapons.

SUMMARY OF THE INVENTION

An ammunition magazine, in accordance with the present invention for small arms weapons having a reciprocating bolt and an ammunition feed well therein, includes a housing for storing a plurality of ammunition rounds and spring means for urging the ammunition rounds out of the housing. As the ammunition rounds are urged out of the housing the spring means decompresses, or unwinds.

Conduit means are provided and configured for insertion into the ammunition feed well. The conduit means communicates with the housing for passing ammunition rounds from the housing and into a position within the small arm weapon for engagement by the reciprocating bolt.

Drive means, communicating with the spring means and associated with the conduit means, engage the reciprocating bolt and cause movement of the reciprocating bolt to compress, or wind, the spring means. This feature enables the magazine of the present invention to utilize a smaller spring than would otherwise be necessary if the spring were not recompressed, or rewound, by movement of the reciprocating bolt as the spring does not have to store sufficient energy to urge all of the ammunition rounds out of the magazine, but only a fraction thereof. In addition, because of the recompression cycle, the spring can operate in its most efficient range of motion.

In fact, the magazine of the present invention is not spring powered, but instead is powered by mechanically tapping off a small amount of energy from the gun on each cycle and the drive means employs a modest spring to buffer the power input from the gun.

More particularly, an ammunition magazine in accordance with the present invention may include a generally cylindrical housing configured for supporting at least one hundred ammunition rounds therein in a plurality of layers with the ammunition rounds in each layer being aligned along radii of the cylindrical housing.

The spring means maybe generally cylindrically shaped and disposed in a coaxial relationship with the cylindrical housing and accumulator means are provided for passing ammunition rounds from the housing into the conduit means. The accumulator means is further operative for accelerating ammunition rounds into the conduit means faster than the cylindrically shaped spring can accelerate ammunition rounds from the housing into the accumulator means.

BRIEF DESCRIPTION OF THE DRAWINGS

The foregoing and other features and advantages of the present invention will be apparent in the following discription taken in conjunction with the accompanying drawings in which.

DETAILED DESCRIPTION OF THE INVENTION

Figure 1:
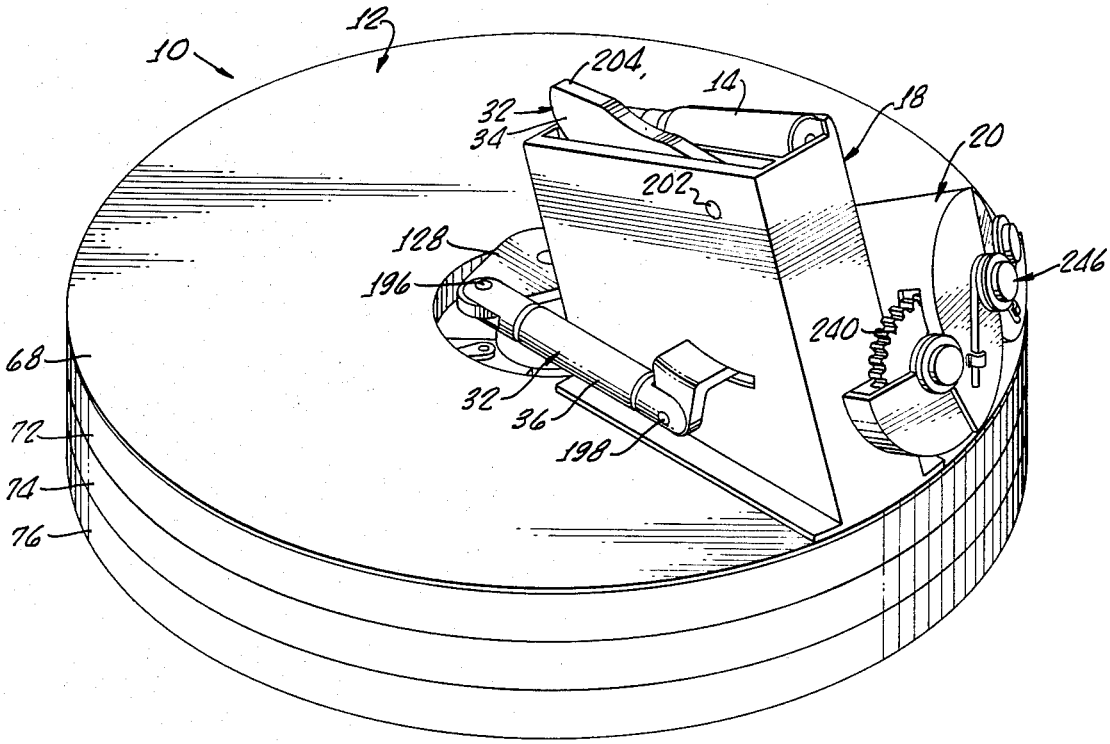
FIG. 1 is a perspective view of an ammunition magazine in accordance with the present invention showing a generally cylindrical housing for storing a plurality of ammunition rounds, conduit means configured for insertion into the ammunition feed well of a small arms weapon and cam drive means associated with the conduit means for engaging a reciprocating bolt of a small arms weapon.
Figure 2:
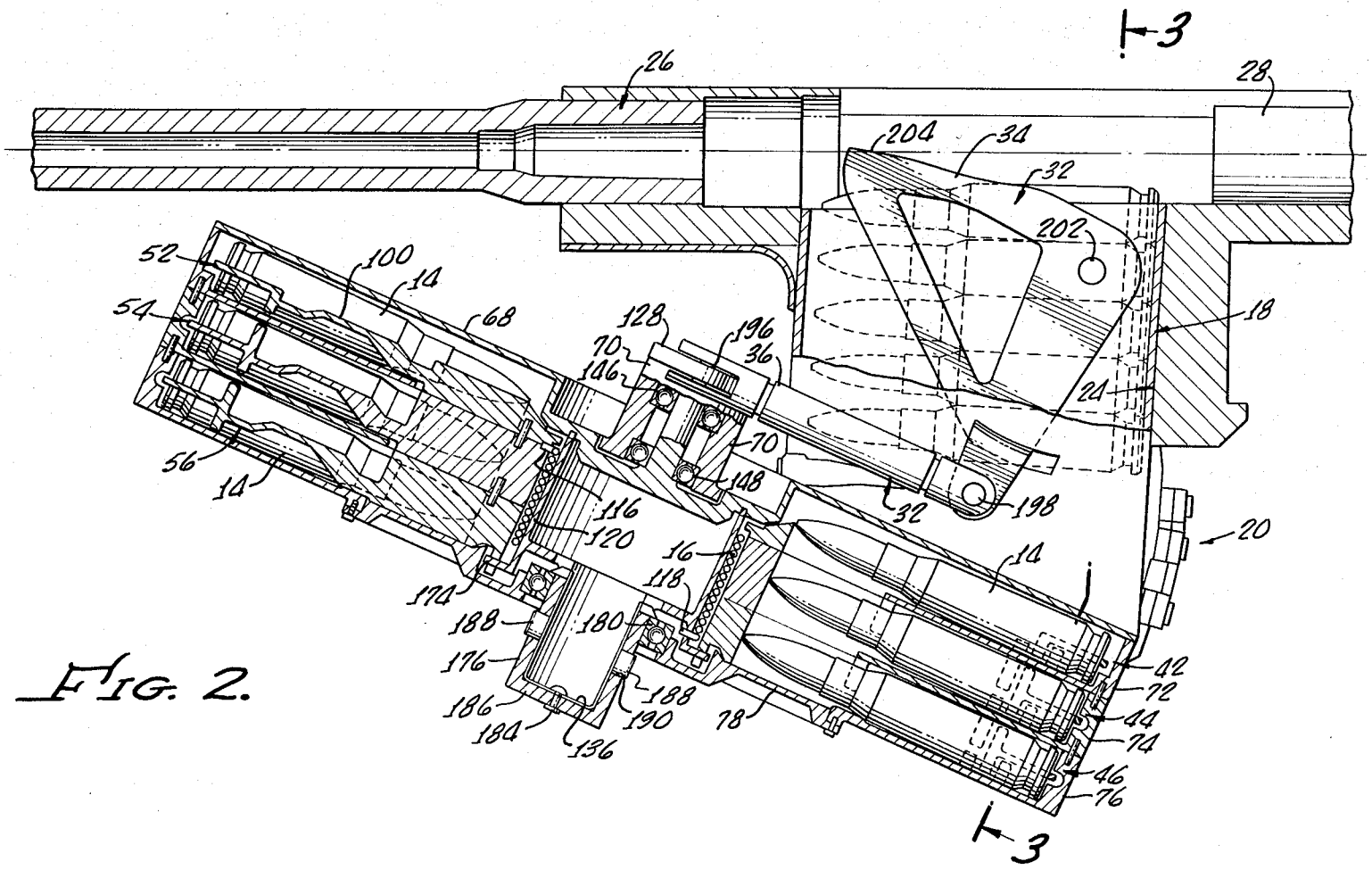
FIG. 2 is a cross section view of the magazine of the present invention in an operative position with a small arms weapon and showing the communication between the cam drive means with a generally cylindrical spring for causing movement of a reciprocating bolt to wind the spring.

Turning to FIGS. 1 and 2, therein shown an ammunition magazine 10 in accordance with the present invention having a housing 12 for storing a plurality of ammunition rounds 14, (FIG. 2) a torsion, or buffer, spring 16 for urging the ammunition rounds out of the housing, a conduit 18 configured for insertion into a feed well 24 of a small arms weapon 26 for passing the ammunition rounds 14 into a position within the small arms weapon for engagement by a reciprocating bolt 28 therein.

An ammunition buffer, or accumulator 20 (FIG. 1) may be provided in order to accommodate a high rate of fire without requiring the spring 16 to be of sufficient size to accelerate all of the ammunition rounds upon initiation of firing, as will be hereinafter discussed.

A cam drive system 32, or means, including a cam 34, disposed within the conduit 18, communicates with the torsion spring 16 by means of a drive rod 36 and is configured for engaging the bolt 28 and causes, as will be hereinafter discussed in greater detail, movement of the bolt to wind the torsion spring 16.

The magazine 10 of the present invention is particularly suited for use with a weapon 26 having a feed well 24 designed for a double row ammunition round clip. Because the conduit 18 provides an ammunition feed in a single row, as more clearly shown in FIG. 3, space is available in the weapon feed well 24 for the cam 34. As shown in FIGS. 1 and 2 the cam 34 is configured and disposed within the feed well 24 for extracting energy from the bolt 28 on the forward stroke of the bolt. Although an alternate configuration, not shown, may be used to extract energy from the bolt 28 on recoil of the bolt, the present configuration is preferred in order not to hinder sufficient aft travel of the bolt.

Figure 4:
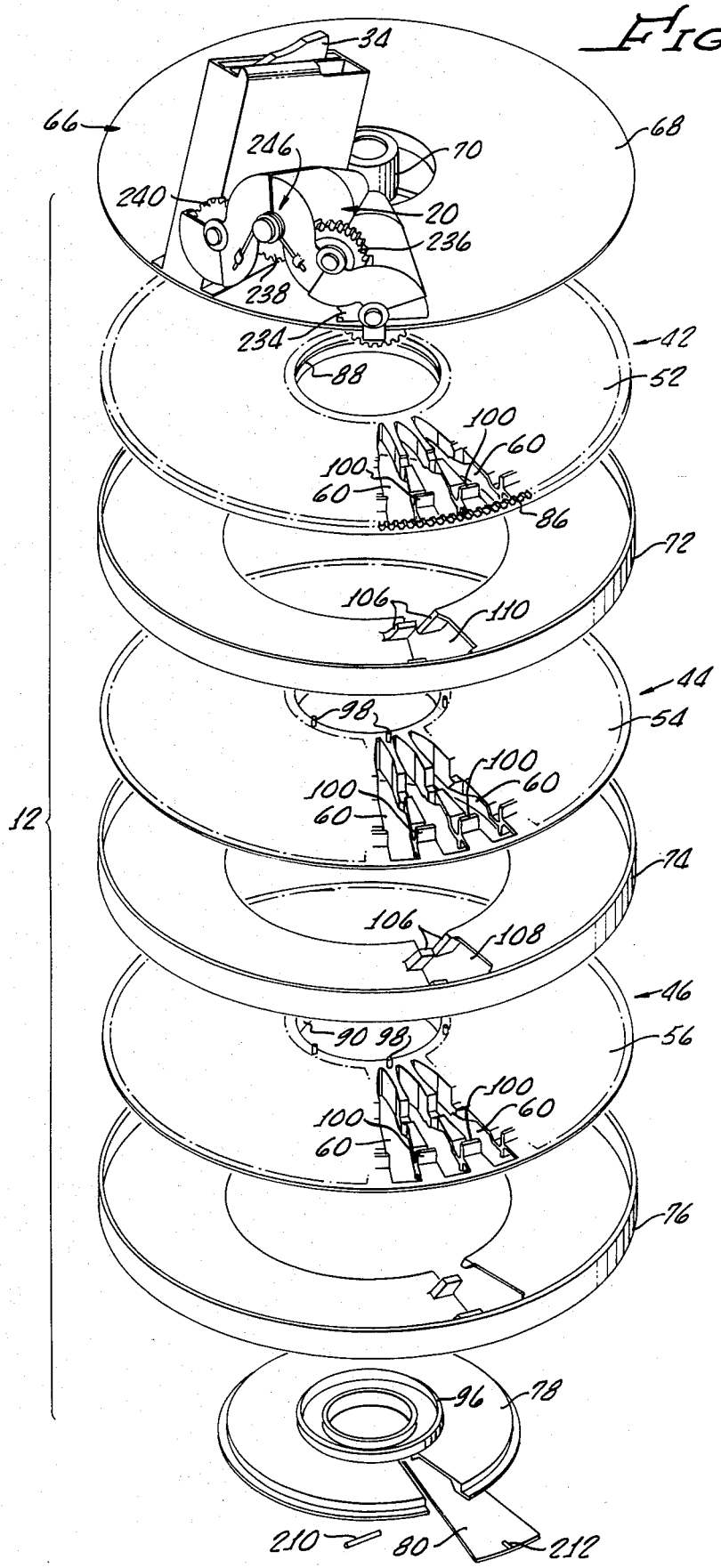
FIG. 4 is an exploded perspective view of the cylindrical housing showing provisions for holding ammunition in a plurality of layers with the ammunition rounds in each layer being aligned along radii of the cylindrical housing.

FIG. 4 more clearly shows the housing 12, which has a generally cylindrical shape, exploded to show three layers 42, 44, 46 of ammunition rounds (not shown in FIG. 4) held by an upper carrier rotor 52, a central carrier rotor 54 and a lower carrier rotor 56. Each of the carrier rotors 52, 54, 56 may be formed from plastic or metal and have cutouts 60 therein for accommodating thirty ammunition rounds in each layer, and holding them in alignment with radii of the cylindrical housing 12.

It is to be appreciated that the ammunition magazine 10 in accordance with the present invention may be configured for a wide range of ammunition calibers. As shown in the accompanying figures, the magazine is designed for 7.62 mm ammunition rounds. In this configuration the housing 12 has an overall diameter of about 213 mm.

In addition, the capacity of the magazine depends upon the number of layers of ammunition rounds utilized. As an example, for 7.62 mm ammunition the housing 12 will accommodate 90 rounds in three layers, or 180 rounds in six layers, with the thickness or depth, of the housing being about 40 mm and 80 mm respectively. It should also be appreciated that the housing 12 may be modular in design enabling a multitude of ammunition capacities by utilization of a varying number of central carrier rotors 54.

Turning again to FIG. 4, the housing 12 further includes an upper closure assembly 66 having a top plate 68 and spring drive housing 70, an upper partition 72, a central partition 74, a lower partition 76 and a lower closure assembly 78 having a loading door 80 therein.

Alternatively, the lower closure assembly 78 may be formed as an integral part of the lower partition. Each of the housing 12 components may be formed of plastic or metal in any known manufacturing process and assembled by gluing, welding or fasteners as may be appropriate.

The upper carrier rotor 52, central carrier rotor 54 and the lower carrier rotor 56 are identical except that the upper carrier rotor has a ring gear 86 disposed thereon for engagement with and driving of the accumulator 20, as will be hereinafter described, and a bearing race 88 for enabling rotational mounting of the carrier rotors 52, 54, 56 within the housing 12. The lower carrier rotor 56 also differs from the central carrier rotor 54 by having a bearing race 90 incorporated on its inside diameter for engagement with a mating portion 96 on the lower closure assembly 78.

A set of pins 98 couple the upper, central and lower carrier rotors 52, 54, 56 to one another for rotation within the housing 12 by the torsion spring 16.

Upon assembly, ammunition rounds 14 are supported in each of the layers 42, 44, 46, by the upper, central and lower partitions 72, 74, 76 and within the cutouts 60 in the upper, central and lower carrier rotors 52, 54, 56. Separators, or vertical surfaces, 100 are formed in the carrier rotors 52, 54, 56 in order to urge the ammunition rounds from the lower carrier rotor to the central carrier rotor and from the central carrier rotor to the upper carrier rotor by means of ramps 106 (FIG. 3) through openings 108, 110 formed in the central and upper partitions 74, 76 as the carrier rotors are rotated.

Figure 3:
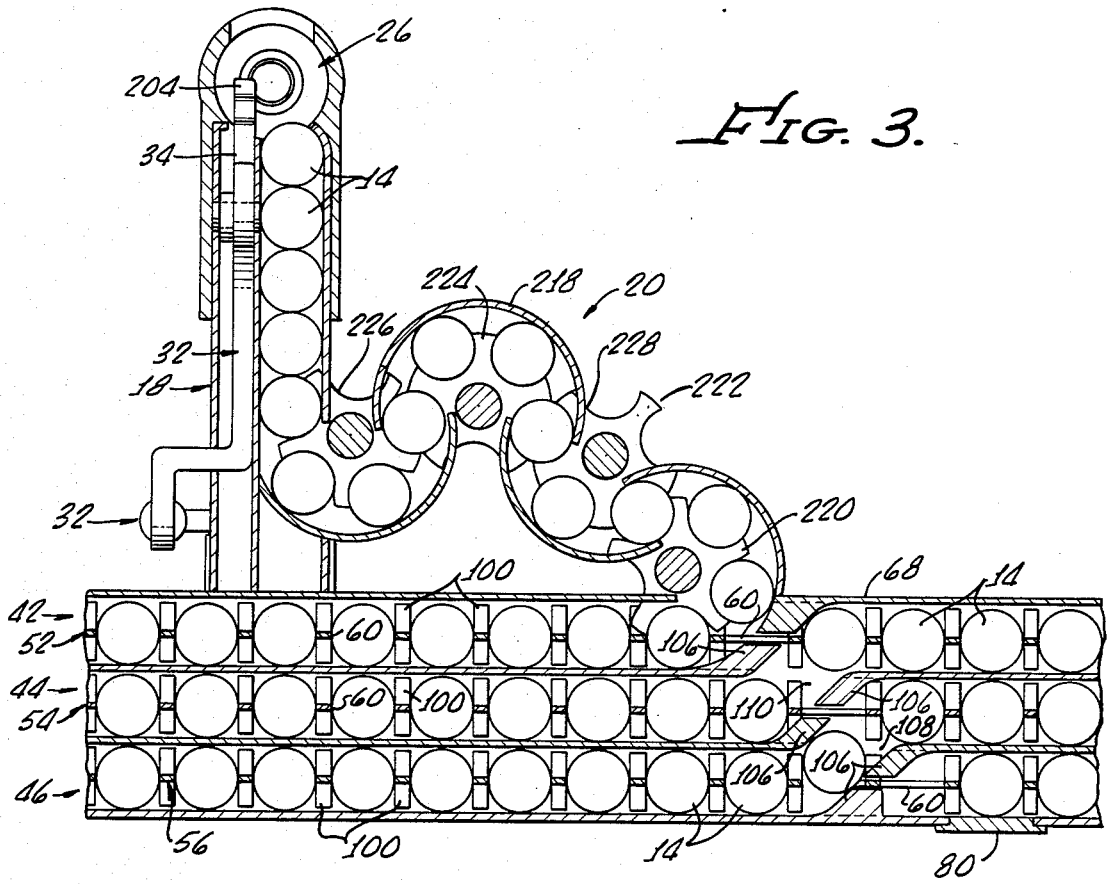
FIG. 3 is a section view taken along line 3—3 of FIG. 2 showing an accumulator communicating between the cylindrical housing and the conduit means and the path of ammunition as it is moved from the magazine and into a position for engagement by the reciprocating bolt of the small arms weapon.

Movement of the ammunition rounds 14 from one layer to another upon rotation of the carrier rotors 52, 54, 56 is more clearly shown in FIG. 3 which additionally shows the path of the ammunition rounds 14 as they are passed from the housing 12 through the accumulator 20 and the conduit 18.

Figure 5:
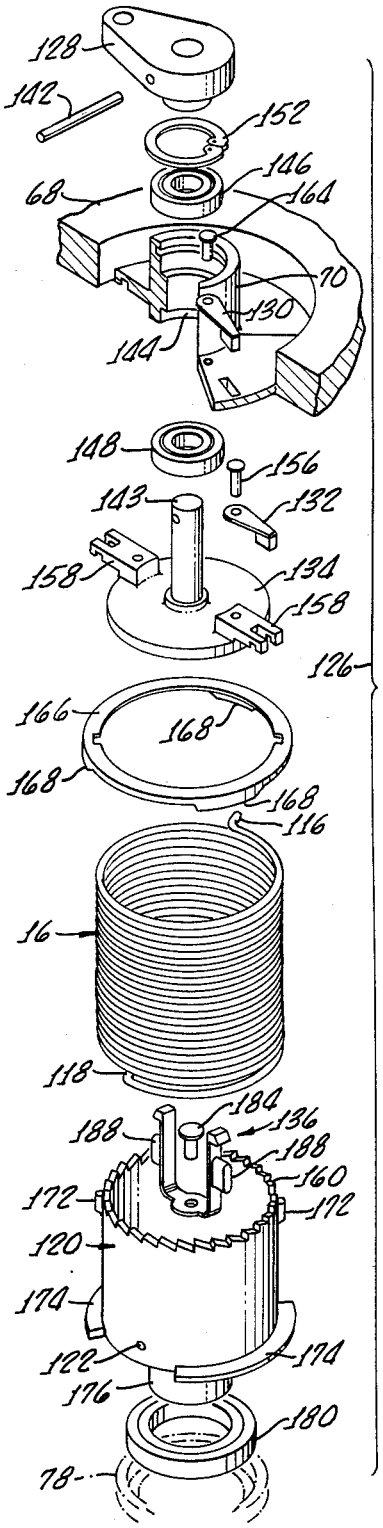
FIG. 5 is an exploded perspective view of the spring mechanism for urging ammunition rounds out of the housing and cam drive means including a bellcrank for winding the spring utilizing the reciprocating movement of the bolt.

Rotation of the carrier rotors 52, 54, 56 is provided by the torsion spring 16 having one end 116 engaging the lower carrier rotor 52 (FIG. 2) and another end 118 engaging a spring carrier 120 through a mating hole 122 therein (FIG. 5).

As shown in FIG. 5 the drive system, or spring means, 126 generally includes the torsion spring 16, the spring carrier 120 as well as a bellcrank 128, holding pawls 130, drive pawls 132, drive pawl carrier 134 and a manual load and wind release clip 136.

The bellcrank 128 is attached by a pin 142 to a portion 143 of the drive pawl carrier 134 extending through a core portion 144 of the housing top 68 and rotatably mounted therein by a pair of bearing 146, 148. A spacer 152 separates the bellcrank from the bearing 146.

Two drive pawls 132 (only one being shown) are pin 156 mounted in a pair of brackets 158 for engagement with a saw tooth portion 160 of the spring carrier 120. Similarly, the pair of holding pawls 130 (only one being shown) are pin 164 mounted to the housing top 68.

An overload release ring 166 is disposed between the spring carrier 120 and the drive pawl carrier 134. Cams 168 on the overload release ring 166 engage a pair of ears 172 on the spring carrier and urge the drive pawl carrier 134 upwardly to thereby relieve both the driving and holding pawls 130, 132 whenever the torsion spring is wound beyond a preselected tension. The preselected tension may vary from magazine to magazine and will depend on the size of the magazine, among other factors.

The torsion spring 16 is disposed on the outside of spring carrier 120 and is supported by a pair of flanges 174 thereon. A lower portion 176 of the spring carrier 120 is rotatably mount to the housing lower closing assembly 78 by means of a bearing 180.

As more clearly shown in FIG. 2 the spring carrier lower portion 176 extends beneath the lower closure assembly 78 and encloses the manual load and wind release clip 136 which is pin 184 mounted to a bottom 186 therein and includes a pair of load buttons 188 which extend through corresponding holes 190 in the spring carrier lower portion 176.

Figure 6:
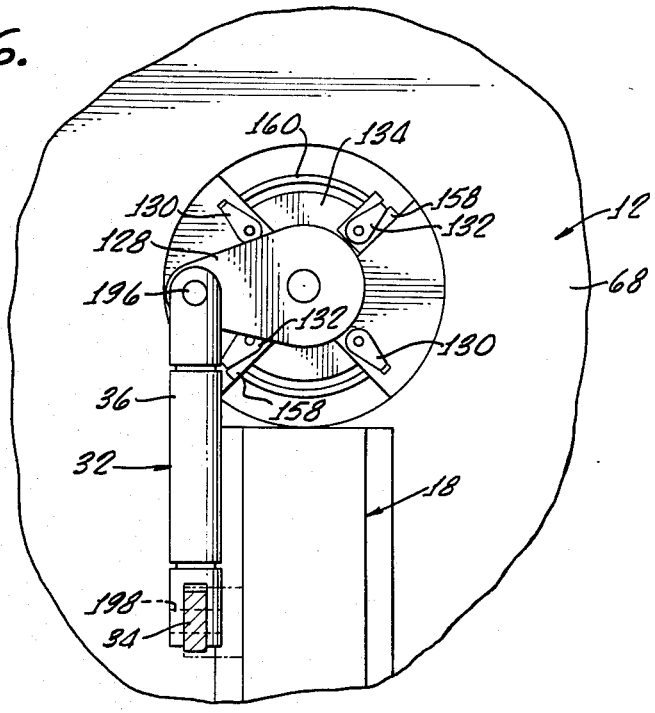
FIG. 6 is a partial top view of the magazine showing a drive arm connected to the bellcrank and the cam drive means.

Turning to FIGS. 1 and 2 and 6 the bellcrank 128 is attached to the cam 34 by means of the drive rod 36 by pins 196, 198 or the like. The cam 34 is pivotally mounted within the conduit 18 at a point 202 enabling a camming surface 204 to engage the bolt 28 and impart an oscillatory motion to the bellcrank 128 and drive pawl carrier 134 with a single power stroke of the bolt 28 causing about a 15 degree rotation of the drive pawl carrier 134.

The drive pawls 132 engage the spring carrier 120 via the saw tooth portion 160 during the power stroke and wind it by a rotation of about 12 degrees. About a 3 degree overstroke is provided to assure a searing engagement between the holding pawls 130 and the saw tooth portion 160. As the holding pawls 130 engage the spring carrier 120 the drive pawl carrier 134 oscillates in reverse to a position for another power stroke.

Operator control of the magazine is provided by the manual load and wind release clip 36. To assure that the torsion spring is prewound to a proper tension, the spring carrier lower portion 176, which may be knurled for gripping, can be wound or twisted until the correct prewind tension is reached at which time the overload release ring 166 will automatically release the pawls 130, 132.

Reloading of the magazine 10 may be accomplished by pushing in the load buttons 188 and pulling down on the spring carrier lower portion to disengage all the pawls 130, 132 after which the carrier rotors 52, 54, 56 may be manually rotated. In this condition the magazine 10 may be loaded either through the conduit 18 or through the lower closure assembly 78 after swinging open the loading door which may be hinge 210 mounted to the lower closure assembly and secured by a clasp 212 or the like.

The accumulator 20 (FIG. 3) may be of any type or configuration suitable having an injection molded or stamped plastic or metal housing 218 and four gear/-shaft rotors 220, 222, 224, 226 having cutout portions 228 thereon for holding and transferring ammunition rounds 14 from the cylindrical housing 12 to the conduit 18. As an example see U.S. Pat. No. 4,344,350 issued Aug. 17, 1982 to M. Golden. The accumulator useful in the present invention is similar to the accumulator disclosed in U.S. Pat. No. 4,344,350 except the accumulator configuration shown herein is generally conical, instead of cylindrical in design.

The accumulator 20 includes a drive gear 234, (FIG. 4) which engages the ring gear 86, and three gears 236, 238, 240 for driving the rotors 220, 222, 224 226 which are mounted with respect to one another to enable an accumulator bias spring 246 to change the relative position of engagement of the gears 236, 238 to force up to two ammunition rounds 14 into the conduit by a "collapse", or realignment, of the gears 236, 238 and associated rotors 222, 224.

As weapon firing commences, the output of ammunition rounds 14 from the housing 12 will lag behind gun demand as the torsion spring 16 accelerates the carrier rotor 52, 54, 56. During this transition the accumulator 20 will supply a "delta" of up to two rounds as the accumulator collapses toward its minimum state by the preloaded bias spring 246.

It should be appreciated that the accumulator may not be required for semi-automatic weapons but is preferable for full automatic fire to reduce drive power requirement on the torsion spring 16 and assume reliable operation.

Figure 8:
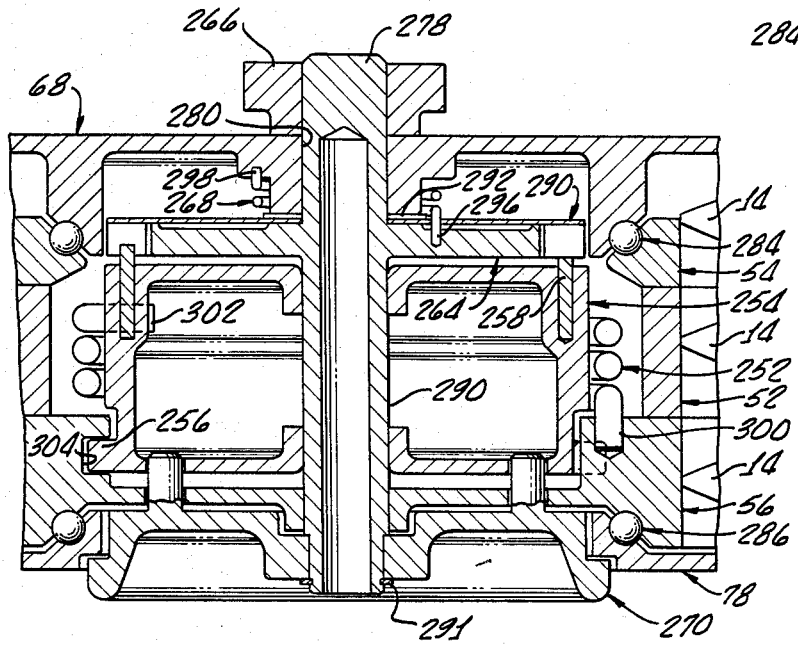
FIG. 8 is a cross section view of the magazine of the present invention showing the alternative spring mechanism therein.
Figure 7:
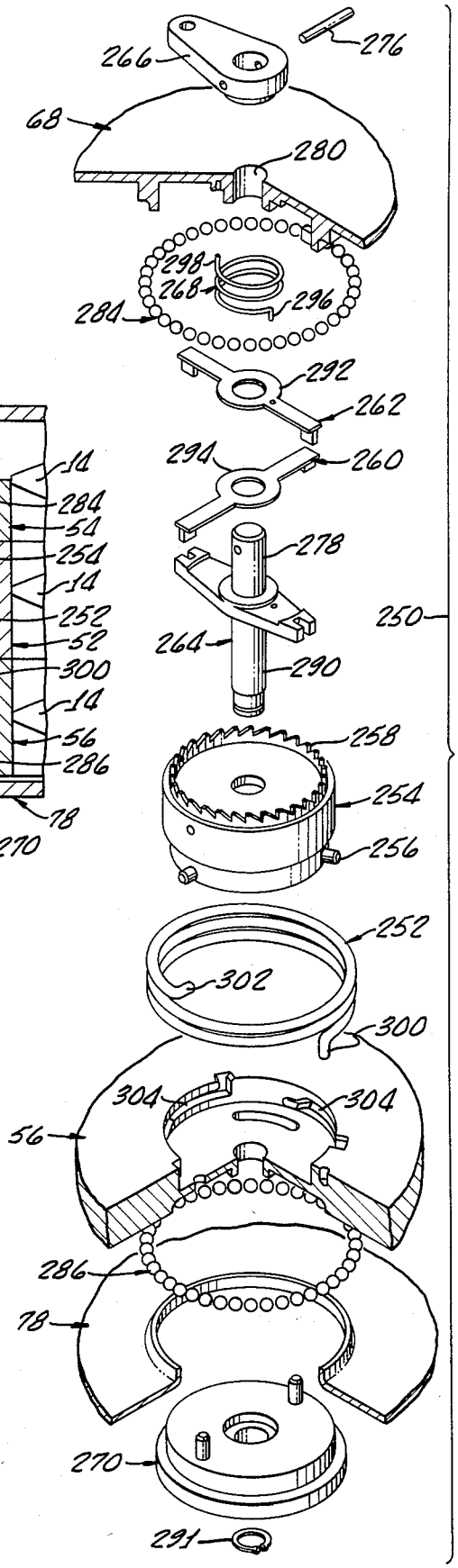
FIG. 7 is an exploded perspective view of an alternative spring mechanism for urging ammunition rounds out of the housing.

A preferred alternative drive system 250 having fewer parts than the drive system 126 is shown in FIGS. 7 and 8. The drive system, or spring means, 250 generally includes a torsion, or buffer, spring 252, a spring carrier 254, a cam follower 256, a rachet 258, holding pawls 260, drive pawls 262, a drive pawl carrier 264, as well as a bellcrank 266, return spring 268 and an operating handle 270.

The bellcrank 266 is attached by a pin 276 to an upper portion 278 of the drive pawl carrier 264 extending through a core portion 280 of the housing tip 68. Bearings 284, 286 enable a rotational mounting of the drive pawl carrier 264 between the housing tip 68 and the lower partition 78 in a coaxial relationship with the spring carrier 254 and the carrier rotors 52, 54, 56 with a lower portion 290 of the drive pawl carrier extending through the spring carrier 254 and the operating handle 270 and fixed therein by a snap ring 291. The carrier rotors 52, 54 are not shown in FIG. 7.

Both the drive pawls 262 and the holding pawls 260 have central portions 292, 294 configured for mounting in a coaxial relationship with the drive pawl carrier on the upper portion 278 thereof.

It should be appreciated that the rachet 258, spring carrier 254 and the cam follower 256 may be formed as a single price molding in order to further reduce the number of separate parts comprising the drive system 250.

The torsion spring is attached to the lower carrier rotor 56 and the spring carrier 254 by means of end portions 300, 302 respectively and the return spring 268 is disposed between the drive pawls 262 and the gousing top 68 and engages the drive pawls and the housing top by means of end portions 296, 298 respectively, to enable return of the drive pawls to a starting position after a power stroke while the holding pawls 260 hold the torsion spring 252 in a charged or compressed state.

An overwind safety release provision including the cam follower 256 and a cam path 304 is incorporated to prevent overwind of the torsion spring 252 as may occur if a magazine jam should occur and the gun operator cycles the bolts 28 repeatedly in an attempt to clear the jam.

The vertical position of the spring carrier 254 is controlled by the cam follower 256 and cam path 304 interface. As long as the torsion spring 252 prewind is less than or equal to preselected tension, the spring carrier is positioned upwardly so the ratchet 258 engages the pawls 260, 262. When the torsion spring tension exceeds the preselected tension the spring carrier is camned downward by the cam path 304 and the cam follower 256, to releasing the engagement of both the holding and the driving pawls 260, 262. Continued activation of the bolt upon release of the spring carrier has no effect on the torsion spring tension.

Operator control of the magazine 10 incorporating the alternative drive system 250 is provided by the operating handle 270. A clockwise rotation of the operating handle assures proper prewind of the torsion spring 252. When the preselected prewind, or tension, is reached, the spring carrier is cammed down as hereinabove discribed and is released from the holding and drive pawls 260, 266. Thereafter the operating handle 270 engages the lower rotor, thus precluding inadvertent operator overwind.

Although there has been described hereinabove a particular arrangement of an ammunition magazine in accordance with the present invention for the purpose of illustrating the manner in which the invention may be used to advantage, it should be appreciated that the invention is not limited thereto. Accordngly, any and all modifications, variations or equivalent arrangements which may occur to these skilled in the art, should be considered to be within the scope of the invention as defined in the appended claims.

I claim:

1. An ammunition magazine for small arm weapons having a reciprocating bolt and an ammunition feed well therein, said ammunition magazine comprising:

a housing for storing a plurality of ammunition rounds;

spring means disposed within said housing for urging said ammunition rounds out of said housing, said spring means decompressing as the ammunition rounds are urged out of said housing;

conduit means, configured for insertion into and removal from the ammunition feed well of a small arm weapon, said conduit means communicating with said housing for passing ammunition rounds from said housing through the conduit means, and into a position within the small arm weapon for engagement by the reciprocating bolt of the small arm weapon when the conduit means is inserted into the small arm weapon ammunition feed well; and, means, communicating with said spring and associated with said conduit means, for engaging the reciprocating bolt and causing movement of the reciprocating bolt to compress the spring means when the conduit means is inserted into the small arm weapon ammunition feed well.

2. An ammunition magazine for small arm weapons having a reciprocating bolt and an ammunition feed well therein, said ammunition magazine comprising:

a housing for storing a plurality of ammunition rounds;

spring means disposed within said housing for urging said ammunition rounds out of said housing, said spring means unwinding as the ammunition rounds are urged out of said housing;

conduit means, configured for insertion into and removal from the ammunition feed well of a small arm weapon, said conduit means communicating with said housing for passing ammunition rounds from said housing and through the conduit means into a position within the small arm weapon for engagement by the reciprocating bolt of the small arm weapon when the conduit means is inserted into the small arm weapon ammunition feed well; and means, communicating with said spring and associated with said conduit means, for engaging the bolt and causing movement of the bolt to wind the spring means when the conduit means is inserted into the small arm weapon ammunition feed well.

3. An ammunition magazine for small arm weapons having a reciprocating bolt and an ammunition feed well therein, said ammunition magazine comprising:

a housing for storing a plurality of ammunition rounds;

a spring means for urging said a housing for storing a plurality of ammunition rounds out of said housing, said spring means unwinding as the ammunition rounds are urged out of said housing;

conduit means, configured for insertion into and removal from the ammunition feed well of a small arms weapon, said conduit means communicating with said housing for passing ammunition rounds from said housing through the conduit means and into a position within the small arm weapon for engagement by the reciprocating bolt of the small arm weapon when the conduit means is inserted into small arm weapon ammunition feed well; and, cam drive means, connected to said spring means and disposed within the conduit means, for engaging the bolt and causing movement of the bolt to wind the spring means when the conduit means is inserted into the small arm weapon ammunition feed well.

4. The ammunition magazine of claim 3 wherein the housing has the general shape of a right cylinder.

5. The ammunition magazine of claim 4 wherein the housing is configured for supporting a plurality of layers of ammunition within the housing with the ammunition in each layer being aligned along radii of the cylindrical housing.

6. The ammunition magazine of claim 5 wherein the conduit means is attached to an end of the cylindrical housing.

7. The ammunition magazine of claim 6 wherein the cylindrical magazine is configured for storing at least 100 ammunition rounds of standard 7.62 mm caliber.

8. The ammunition magazine of claim 6 wherein the spring means comprises a cylindrically shaped spring.

9. The ammunition magazine of claim 8 wherein the cylindrically shaped spring is disposed in a coaxial relationship with the cylindrical housing.

10. An ammunition magazine for small arm weapons having a reciprocating bolt and an ammunition feed well therein, said ammunition magazine comrising:

a housing for storing a plurality of ammunition rounds;

spring means for urging said ammunition rounds out of said housing, said spring means unwinding as the ammunition rounds are urged out of said housing;

conduit means, configured for insertion into and removal from the ammunition feed well for passing ammunition rounds into a position within the small arm weapon for engagement by the reciprocating bolt of the small arm weapon when the conduit means is inserted into the small arm weapon ammunition feed well;

accumulator means, communicating with the conduit means and the housing, for passing ammunition rounds from the housing into the conduit means; and cam drive means, connected to said spring means and disposed within the conduit means, for engaging the bolt and causing movement of the bolt to wind the spring means when the conduit means is inserted into the small arm weapon ammunition feed well.

11. The ammunition magazine of claim 10 further comprising accumulator spring means for accelerating ammunition rounds into the conduit means faster than the spring means can accelerate ammunition rounds from the housing into the accumulator means.

12. An ammunition magazine for small arm weapons having reciprocating bolt and an ammunition feed well therein, said ammunition magazine comprising:

a generally cylindrical housing configured for supporting at least 90 ammunition rounds of standard 7.62 mm caliber therein in plurality of layers with the ammunition rounds in each layer being aligned along radii of the cylindrical housing;

spring means, including a generally cylindrically shaped spring disposed in a coaxial relationship with the cylindrical housing, for urging said ammunition rounds out of the cylindrical housing, said cylindrically shaped spring unwinding as the ammunition rounds are urged out of the cylindrical housing;

conduit means, configured for insertion into and removal from the ammunition feed well for passing ammunition rounds into a position within the small arm weapon for engagement by the reciprocating bolt of the small arm weapon when the conduit means is inserted into the small arm weapon ammunition feed well;

accumulator means, communicating with the conduit means and the housing, for passing ammunition rounds from the housing into the conduit means, said accumulator means being further operative for accelerating ammunition rounds into the conduit means faster than the cylindrically shaped spring can accelerate ammunition rounds from the housing into the accumulator means; and, cam drive means, connected to said cylindrically shaped spring and disposed within the conduit means, for engaging the bolt and causing movement of the bolt to wind the cylindrically shaped spring when the conduit means is inserted into the small arm weapon ammunition feed well.

13. The ammunition magazine of claim 12 further including manually operative means for winding the spring means.

14. The ammunition magazine of claim 13 further including means for temporarily releasing the spring means to enable the spring means to unwind to a preselected compression if the spring means compression becomes greater than a desired amount.

15. The ammunition magazine of claim 12 further including manually operative means for preventing the spring means from urging ammunition rounds and enabling manual loading of ammunition rounds into the housing.

* * * * *

UNITED STATES PATENT AND TRADEMARK OFFICE

CERTIFICATE OF CORRECTION

PATENT NO. : 4,524,673

DATED : June 25, 1985

INVENTOR(S) : Michael D. Golden

It is certified that error appears in the above—identified patent and that said Letters Patent is hereby corrected as shown below:

In column 8, lines 45-46, claim 3, delete "a housing for storing a plurality of".

In column 9, line 16, claim 10, delete "comrising" and insert therefor --comprising--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*